US008267400B2

(12) United States Patent
Nishikata et al.

(10) Patent No.: US 8,267,400 B2
(45) Date of Patent: Sep. 18, 2012

(54) SHEET PROCESSING APPARATUS

(75) Inventors: Kazushi Nishikata, Odawara (JP); Shuji Nishitani, Suntou-Gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/150,521

(22) Filed: Jun. 1, 2011

(65) Prior Publication Data

US 2011/0227274 A1 Sep. 22, 2011

Related U.S. Application Data

(62) Division of application No. 12/337,002, filed on Dec. 17, 2008, now Pat. No. 7,979,002.

(30) Foreign Application Priority Data

Dec. 27, 2007 (JP) ..... 2007-336847

(51) Int. Cl.
*B65H 5/00* (2006.01)
*G03G 15/00* (2006.01)
*G03G 21/00* (2006.01)

(52) U.S. Cl. ..... 271/264; 271/9.13; 399/124; 399/125; 399/110

(58) Field of Classification Search ..... 271/9.13, 271/9.11, 9.12, 264; 399/110, 124, 125
See application file for complete search history.

(56) References Cited

U.S. PATENT DOCUMENTS

| | | | |
|---|---|---|---|
| 4,556,308 | A | 12/1985 | Hoppner et al. |
| 5,765,826 | A | 6/1998 | Isoda et al. |
| 6,134,404 | A | 10/2000 | Iwai et al. |
| 6,571,074 | B2 | 5/2003 | Suzuki et al. |
| 6,877,742 | B2 | 4/2005 | Nishikata et al. |
| 7,032,900 | B2 | 4/2006 | Nishikata et al. |
| 7,416,181 | B2 | 8/2008 | Murakami et al. |
| 7,819,394 | B2 | 10/2010 | Shiohara et al. |
| 2008/0063430 | A1 | 3/2008 | Nobuoka et al. |

FOREIGN PATENT DOCUMENTS

| | | | |
|---|---|---|---|
| JP | 07-215536 | A | 8/1995 |
| JP | 09-290942 | A | 11/1997 |
| JP | 2005-031377 | | 2/2005 |
| JP | 2006-091599 | A | 4/2006 |
| JP | 2006-259449 | | 9/2006 |

OTHER PUBLICATIONS

Japanese Office Action, dated Apr. 24, 2012, issued by the Japanese Patent Office, in Japanese Patent Application No. 2007-336847.

*Primary Examiner* — Luis A Gonzalez
(74) *Attorney, Agent, or Firm* — Fitzpatrick, Cella, Harper & Scinto

(57) ABSTRACT

A sheet processing apparatus includes an opening/closing member which is turnably supported by an apparatus body and through which a user accesses the apparatus, and a conveying guide which is movably supported by a user access door and which includes a sheet conveying surface. When the opening/closing member is opened in a state where a sheet remains on the sheet conveying surface, the conveying guide is separated from the opening/closing member by the remaining sheet.

9 Claims, 13 Drawing Sheets

SHEET PROCESSING APPARATUS

This application is a divisional of U.S. patent application Ser. No. 12/337,002, filed Dec. 17, 2008, and allowed on Mar. 3, 2011.

BACKGROUND OF THE INVENTION

1. Field of the Invention

The present invention relates to a sheet processing apparatus having a conveying guide for guiding a sheet.

2. Description of the Related Art

As an apparatus which processes a sheet, there is an image forming apparatus which forms an image on a sheet. There is an image forming apparatus in which a two-sided unit is mounted on a side surface or an upper surface of an apparatus body so that images can be formed on both sides of a sheet. An optional paper feed apparatus which feeds sheets to the apparatus body proceeds toward commercialization.

User's needs for downsizing the image forming apparatus have grown. It is required to bring a plurality of conveying paths such as a sheet conveying path in the two-sided unit and a paper feed sheet conveying path from the paper feed apparatus adjacent to each other, thereby downsizing the apparatus. Further, it is necessary to secure a sufficient operation space for jam recovery for a user.

In an area of the image forming apparatus body where a plurality of conveying paths such as a conveying path from a sheet paper feed apparatus, a conveying path from the two-sided unit and an optional paper feed sheet conveying path merge with each other, a plurality of conveying guides and conveying rollers are closely provided. It is both important to carry out the jam recovery operation and to secure the space.

In a copier disclosed in Japanese Patent Application Laid-Open No. 2005-31377, an opening/closing cover is turnably mounted on a copier body. A movable paper guide is movably mounted on the copier body. If the opening/closing cover is opened, the movable paper guide is opened. However, since the movable paper guide is mounted on the copier body, the opening degree of the conveying path caused by movement of the movable paper guide is small and thus, the operability of the jam recovery is poor. In an area where the conveying path is largely bent and a plurality of conveying paths exist in a narrow space, the position precision of a sheet guide is important. In the copier disclosed in Japanese Patent Application Laid-Open No. 2005-31377, since the movable paper guide is mounted on the copier body, it is difficult to secure the position precision of the conveying roller and the movable paper guide of the opening/closing cover.

According to a structure disclosed in Japanese Patent Application Laid-Open No. 2006-259449, two conveying paths, i.e., a sheet conveying path passing through an image forming portion and a sheet conveying path of the two-sided unit are simultaneously opened by a user's operation for turning the two-sided unit (door) with respect to the apparatus body. Here, if the two-sided unit (door) is turned with respect to the apparatus body to open the conveying path from the sheet paper feed apparatus of the apparatus body, roller nips of a pair of registration roller and a pair of rollers of the two-sided unit are released. By releasing the roller nips, processing operability of sheets remaining in the sheet conveying path is enhanced.

However, if the roller nips of the pair of registration roller and the pair of rollers of the two-sided unit are released, although the processing operability of remaining sheets is enhanced, the following problems come up.

It is difficult to align a pair of rollers such as registration rollers. If the rollers are not aligned, a sheet is skew fed, and forming precision of an image is deteriorated.

Generally, high nip pressure is set for a pair of rollers. When thick paper sheets of 200 g/mm or more are conveyed, for example, high nip pressure is required so that sheet conveying speed is not reduced with respect to the image forming portion. For a pair of rollers which convey sheets in a bent sheet conveying path, it is necessary to set a nip pressure as high as 1 kgf to 2 kgf so that the rollers and the sheet do not slip due to conveying resistance of the sheet.

If a high nip pressure is set for a pair of rollers, a user must operate a user door against the nip pressure. Thus, the operability of the user's door is deteriorated. If a high nip pressure is set in the pair of rollers, a strong casing is required to handle the nip pressure. Thus, if a structure in which the pair of rollers are held by resin material, countermeasures against deformation such as creep are required. In the case of a structure in which the nip of a pair of rollers is released as a door is turned as in Japanese Patent Application Laid-Open No. 2006-259449, it is difficult to secure the strength.

A structure in which nip of a pair of rollers is not released even if a door is opened or closed can be conceived. However, if the nip of the pair of rollers is not released even when the door is turned, the following problems come up.

When sheets remain in a state where the sheets are nipped by a plurality of pairs of rollers, the conveying guide comes into contact with the remaining sheets if a user opens the door. If the user further opens the door, the conveying guide tears the sheets. Further, there is a fear that the conveying guide is damaged by the sheets.

This problem will be described using FIG. 13 which is a sectional view of a sheet conveying portion near a door. FIG. 13 illustrates a state where a door 150 having a conveying guide 139 is opened. The door 150 is opened without releasing the roller nips of the pair of rollers 114 and the pair of two-sided rollers 135. The remaining sheet S is nipped between the pair of rollers 114 and the pair of two-sided rollers 135. When the door 150 is opened, the conveying guide 139 disposed on the door 150 turns toward the sheet nipped (in the direction of the arrow A) by the pair of rollers 114 and the pair of two-sided rollers 135. Therefore, there is a fear that the sheet S is pulled by the tip end 139*a* of the conveying guide 139 by the turning motion of the door 150 and is torn, and a flake of the sheet remains in the apparatus. There is a fear that the tip end 139*a* of the conveying guide 139 is damaged by the sheet. Further, tension of the sheet nipped between the two roller nips becomes a resistance when the door 150 turns, and the operability is deteriorated.

To solve the above problem, it is conceived that a plurality of user access doors corresponding to the plurality of conveying paths are provided, but a user can not easily find a door which should be opened at the time of jam recovery, and the operability is poor.

SUMMARY OF THE INVENTION

The present invention has been accomplished in view of these problems, and the present invention provides a sheet processing apparatus in which a sheet or a conveying guide is prevented from being damaged by opening motion of a door to remove a remaining sheet.

To solve the problem, a sheet processing apparatus of the present invention comprising: an opening/closing member turnably supported by an apparatus body; and a conveying guide which is movably supported by the opening/closing member and which has a sheet conveying surface; wherein when the opening/closing member is opened in a state where a sheet remains on the sheet conveying surface, the conveying guide moves with respect to the opening/closing member by the sheet S which remains on the sheet conveying surface.

According to the present invention, a processing operation can be carried out without tearing a remaining sheet or damaging the conveying guide.

Further features of the present invention will become apparent from the following description of exemplary embodiments (with reference to the attached drawings).

DESCRIPTION OF THE EMBODIMENTS

First Embodiment

A first embodiment of an image forming apparatus which is one example of a sheet processing apparatus of the present invention will be described in detail with reference to the drawings.

[Entire Structure of Image Forming Apparatus]

First, the entire structure of the image forming apparatus will be described briefly with reference to FIG. 1. The image forming apparatus of the first embodiment has such a structure that an optional paper feed apparatus (sheet feed optional portion, hereinafter) 200 is added to a lower portion of a color laser printer (printer portion, hereinafter) 100 which is an image forming apparatus body, and FIG. 1 is a vertical sectional view illustrating the entire structure thereof.

(Image Forming Process Portion)

Figure 1:
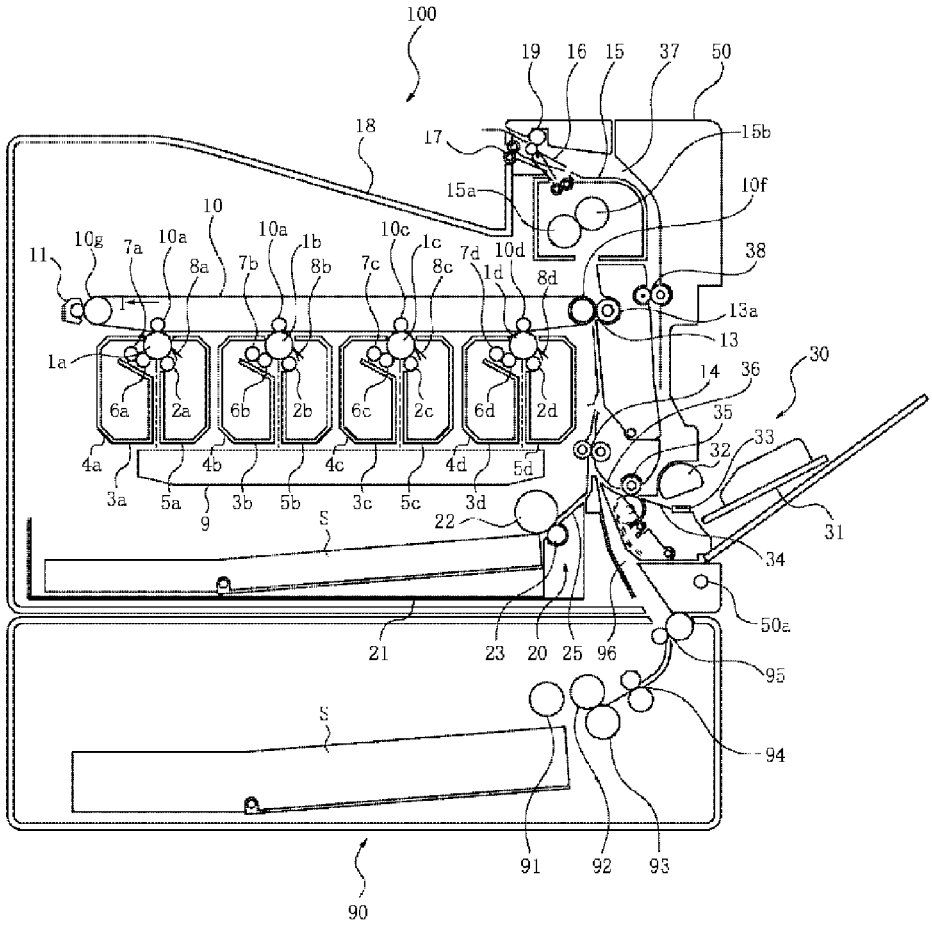
FIG. 1 is a vertical sectional view for describing an outline structure of an image forming apparatus according to a first embodiment of the present invention.

The printer portion 100 illustrated in FIG. 1 includes process cartridges 3*a*, 3*b*, 3*c* and 3*d* which can detachably attachable to an apparatus body. These four process cartridges 3*a*, 3*b*, 3*c* and 3*d* have the same structures but form different colors. That is, the process cartridge 3*a* form a yellow (Y) toner image, the process cartridge 3*b* forms a magenta (M) toner image, the process cartridge 3*c* forms a cyan (C) toner image, and the process cartridge 3*d* forms a black (Bk) toner image. The process cartridges 3*a*, 3*b*, 3*c* and 3*d* respectively include developing units 4*a*, 4*b*, 4*c* and 4*d* for developing toner images of respective colors, and cleaner units 5*a*, 5*b*, 5*c* and 5*d*.

The developing units 4*a*, 4*b*, 4*c* and 4*d* respectively include developer applying rollers 6*a*, 6*b*, 6*c* and 6*d*; developing rollers 7*a*, 7*b*, 7*c* and 7*d*; and toner containers.

The cleaner units 5*a*, 5*b*, 5*c* and 5*d* respectively include photosensitive drums 1*a*, 1*b*, 1*c* and 1*d* which are image bearing members; charge rollers 2*a*, 2*b*, 2*c* and 2*d*; drum cleaning blades 8*a*, 8*b*, 8*c* and 8*d*; and waste toner containers.

A scanner unit 9 is disposed vertically below the process cartridges 3*a*, 3*b*, 3*c* and 3*d*, and the photosensitive drums 1*a*, 1*b*, 1*c* and 1*d* are exposed based on an image signal.

After the photosensitive drums 1*a*, 1*b*, 1*c* and 1*d* are predetermined negatively charged by the charge rollers 2*a*, 2*b*, 2*c* and 2*d*, they are formed with electrostatic latent images by the scanner unit 9. The electrostatic latent images are inversely developed by the developing units 4*a*, 4*b*, 4*c* and 4*d*, negative toner is adhered, and toner images of Y, M, C and Bk are formed.

In the intermediate transfer belt unit 10, an intermediate transfer belt 10*e* is wound around a driver roller 10*f* and a tension roller 10*g*. Tension in the direction of the arrow T is applied to the intermediate transfer belt 10*e* in the intermediate transfer belt unit 10 by the tension roller 10*g*. Primary transfer rollers 10*a*, 10*b*, 10*c* and 10*d* are disposed inside the intermediate transfer belt 10*a* such as to be opposed to the photosensitive drums 1*a*, 1*b*, 1*c* and 1*d* respectively. A transfer bias is applied to the primary transfer rollers 10*a*, 10*b*, 10*c* and 10*d* by a bias application unit (not illustrated).

The toner images formed on the photosensitive drums 1*a*, 1*b*, 1*c* and 1*d* are primarily transferred to the intermediate transfer belt 10*e*, sequentially. That is, the respective photosensitive drums are rotated in the clockwise direction in FIG. 1. The intermediate transfer belt 10*e* is rotated in the counterclockwise direction. The toner images are transferred to the rotating intermediate transfer belt 10*e* from the upstream photosensitive drums sequentially. The toner images are transferred from the photosensitive drums 1*a*, 1*b*, 1*c* and 1*d* to the intermediate transfer belt 10*e* by applying positive bias to the primary transfer rollers 10*a*, 10*b*, 10*c* and 10*d*. A toner image formed on the intermediate transfer belt 10*e* such that the toner images of four colors are superposed on one another is moved to a secondary transfer portion 13.

Toner remaining on surfaces of the photosensitive drums 1*a*, 1*b*, 1*c* and 1*d* after the toner image is transferred is removed by cleaning blades 8*a*, 8*b*, 8*c* and 8*d*. Toner remaining on the intermediate transfer belt 10*e* after the secondary transfer to the sheet S is removed by a transfer belt cleaning apparatus 11. The removed toner passes through a waste toner conveying path (not illustrated), and is collected in a waste toner recovery container (not illustrated) disposed in a deep side of the apparatus.

(Sheet Feeder)

The image forming apparatus of the embodiment includes three sheet paper feed apparatuses (sheet feeders). A first sheet feeder is a body sheet feeder 20 provided in the printer portion 100. A second sheet feeder is a manual sheet feeder 30 provided on a side surface of the printer portion 100. A third sheet feeder is a sheet feed optional portion 90 added below the printer portion 100.

The body sheet feeder 20 includes a sheet feed roller 22 which feeds sheets S from a sheet feed cassette 21 in which sheets S are accommodated, and a separating roller 23 which is a separating unit. The sheets S accommodated in the sheet feed cassette 21 are brought into contact with the sheet feed roller 22 under pressure, and separated one sheet by one sheet by the separating roller 23 and is conveyed. The separated sheet S is conveyed to the pair of registration rollers 14 through the body sheet feed conveying path 25.

The manual sheet feeder 30 includes an intermediate plate 31 on which sheets S are stacked, a manual sheet feed roller 32 which feeds the uppermost sheet S on the intermediate plate 31, and a separating pad 33 which is a separating unit. The intermediate plate 31 is lifted up, the sheets S stacked on the intermediate plate 31 are brought into contact with the manual sheet feed roller 32 under pressure, separated one sheet by one sheet by the separating pad 33 and conveyed. The separated sheets S are conveyed to the pair of sheet re-feed rollers 35 through the manual sheet feed conveying path 34. The sheets S conveyed by the pair of sheet re-feed rollers 35 pass through the sheet re-feed conveying path 36 and conveyed to the pair of registration rollers 14. The pair of sheet re-feed rollers 35 and the sheet re-feed conveying path 36 become common conveying paths which can be used at the time of two-sided conveyance.

The optional paper feed apparatus 90 includes a pickup roller 91, a feed roller 92 and a retard roller 93. The sheets are separated one sheet by one sheet from the stacked sheet bundle in cooperation of the pickup roller 91, the feed roller 92 and the retard roller 93, and the separated sheet is conveyed. The conveyed sheet is conveyed to the apparatus body of the printer portion 100 through a pair of relay conveying rollers 94 and a pair of optional discharge rollers 95. An optional sheet feed conveying path 96 is provided in the printer portion 100. The sheet S conveyed by the optional paper feed apparatus 90 is conveyed to the pair of registration rollers 14 through the optional sheet feed conveying path 96.

As described above, three conveying paths merge with each other upstream of the pair of registration rollers 14 of the printer portion 100.

(Secondary Transfer Portion and Fixing Portion)

The secondary transfer portion 13 transfers a toner image formed on the intermediate transfer belt 10*e* to a sheet. The secondary transfer portion 13 includes a secondary transfer roller 13*a* to which positive bias is applied. If the positive bias is applied to the secondary transfer portion 13, a toner image of four colors on the intermediate transfer belt 10*e* is secondary transferred to the sheet S conveyed by the pair of registration rollers 14.

A fixing portion 15 including a fixing roller 15*a* and a pressure roller 15*b* is provided above the secondary transfer portion 13. A sheet onto which the toner image is transferred is conveyed to the nip of the fixing roller 15*a* and the pressure roller 15*b*, the sheet is heated and pressurized by the fixing roller 15*a* and the pressure roller 15*b*, and the toner image transferred to the surface of the sheet is fixed.

(Reverse Discharge Portion)

A switching member 16, a pair of discharge rollers 17 and a pair of switchback rollers 19 are provided above the fixing portion 15.

A conveying path of the fixed sheet S is switched selectively depending upon a position of the switching member 16 in accordance with previously selected one-sided printing or two-sided printing.

When the one-sided printing is selected, the fixed sheet S is guided toward the pair of discharge rollers 17 by the switching member 16 located at the solid line position. The sheet which is guided by the pair of discharge rollers 17 is discharged onto the discharge stack tray 18 which is an upper surface of the apparatus body.

When the two-sided printing is selected, the sheet S is guided toward the pair of switchback rollers 19 by the switching member 16 located at a dotted line. Here, the pair of switchback rollers 19 convey the sheet S toward the discharge stack tray 18 and then, the pair of switchback rollers 19 reversely rotate at timing when a rear end of the sheet S passes through the fixing portion 15, thereby conveying the sheet S to a two-sided inverse conveying path 37. At the same time when the pair of switchback rollers 19 reversely rotate, the switching member 16 moves from the dotted line position to the solid line position to guide the sheet S to the two-sided inverse conveying path 37.

A pair of two-sided conveying rollers 38 conveys a sheet S to the pair of sheet re-feed rollers 35. A sheet S which is re-fed by the pair of sheet re-feed rollers 35 merges with the sheet re-feed conveying path 36 in a state where the sheet is turned over (front surface and back surface are inversed), and the sheet S is again conveyed to the pair of registration rollers 14. The sheet conveying operation and the image transfer operation after the pair of registration rollers 14 are the same as those of the above described one-sided printing.

(Two-Sided Sheet Re-Feeder)

Figure 2:
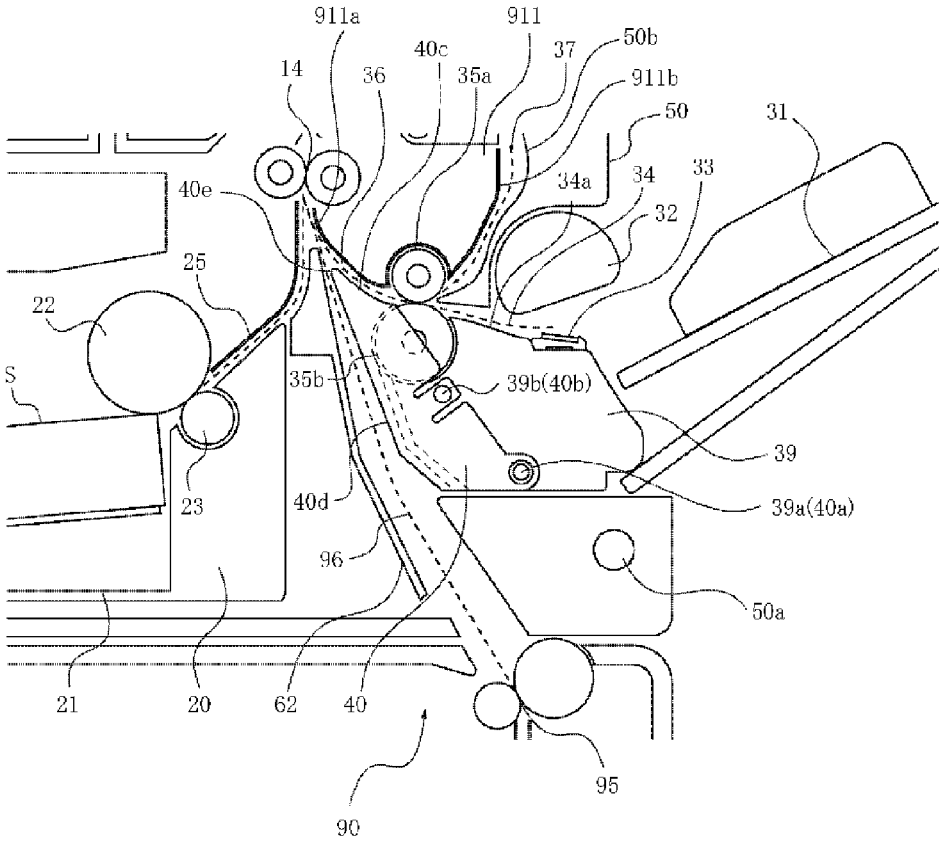
FIG. 2 is an enlarged view of an upstream area of a pair of registration rollers illustrated in FIG. 1.

Next, a structure of the two-sided sheet re-feeder located upstream of the pair of registration rollers 14 and with which a sheet from the three sheet feed portions and the two-sided inverse conveying path 37 merge will be described. FIG. 2 is an enlarged view of two-sided sheet re-feeder and peripheries thereof.

A manual sheet feed frame 39 holds a manual sheet feed roller 32, a separating pad 33, and a sheet re-feed roller 35*a* and a sheet re-feed roller 35*b* constituting a pair of sheet re-feed rollers 35 as a pair of first conveying rollers. The manual sheet feed frame 39 includes a manual sheet feed guide surface 34*a* which forms a manual sheet feed conveying path 34.

A sheet re-feed conveying guide member 40 as a conveying guide forms a sheet re-feed conveying path 36 as a first conveying path located downstream from the pair of sheet re-feed rollers 35*a* and 35*b* in the sheet conveying direction. The sheet re-feed conveying guide member 40 includes a first sheet re-feed conveying guide surface 40*c* as a sheet conveying surface for guiding a sheet. The sheet re-feed conveying guide member 40 further includes a first optional sheet feed conveying path surface 40*d*. The first optional sheet feed conveying path surface 40*d* forms an optional sheet feed conveying path 96 which is a second conveying path, and guides a sheet which passes through the optional sheet feed conveying path 96. The sheet re-feed conveying guide member is provided at its one side with a first sheet re-feed conveying guide surface 40*c* which forms the sheet re-feed conveying path 36, and is provided at its other side with a first optional sheet feed conveying path surface 40*d* which forms the optional sheet feed conveying path 96.

The sheet re-feed conveying guide member 40 is movably provided on the manual sheet feed frame 39. That is, the rotation shaft 39*a* provided on the manual sheet feed frame 39 is fitted into a fitting hole 40*a* of the sheet re-feed conveying guide member 40. With this, the sheet re-feed conveying guide member 40 is supported such that it can rotate with respect to the manual sheet feed frame 39. In this embodiment, the rotation shaft 39*a* and the fitting hole 40*a* of the sheet re-feed conveying guide member 40 constitute a movable unit which can move the sheet re-feed conveying guide member 40. A boss 39*b* which is a projection provided on the manual sheet feed frame 39 engages with an engaging hole 40*b* of the sheet re-feed conveying guide member 40. With this, the sheet re-feed conveying guide member 40 is engaged with the manual sheet feed frame 39.

A curve guide member 911 as a guide is provided near the pair of registration rollers 14 as the pair of second conveying rollers. A user access door 50 as an opening/closing member which can turn with respect to the apparatus body is provided on the side of the image forming apparatus 100. The user access door 50 is formed with a first inverse conveying guide surface 50*b* which forms one side of the two-sided inverse conveying path 37. The curve guide member 911 is formed with a second inverse conveying guide surface 911*b* which forms the other side of the two-sided inverse conveying path 37.

As described above, the first sheet re-feed conveying guide surface 41*c* is formed on the upper surface of the sheet re-feed conveying guide member 40, and the sheet re-feed conveying path 36 is formed. The curve guide member 911 is provided with a second sheet re-feed conveying guide surface 911*a* which forms the sheet re-feed conveying path 36. That is, the sheet re-feed conveying path 36 which is a conveying path between the pair of sheet re-feed rollers 35 and the pair of registration rollers 14 are formed of the first sheet re-feed conveying guide surface 41*c* of the sheet re-feed conveying guide member 40 and the second sheet re-feed conveying guide surface 911*a* of the curve guide member 911.

A sheet feed conveying guide 62 is provided between the manual sheet feed frame 39 and the body sheet feed portion 20. The sheet feed conveying guide 62 forms the optional sheet feed conveying path 96 and the body sheet feed conveying path 25.

The user access door 50 holds the manual sheet feed portion 30, the manual sheet feed frame 39, the pair of sheet re-feed rollers 35 and the curve guide member 911.

Figure 3:
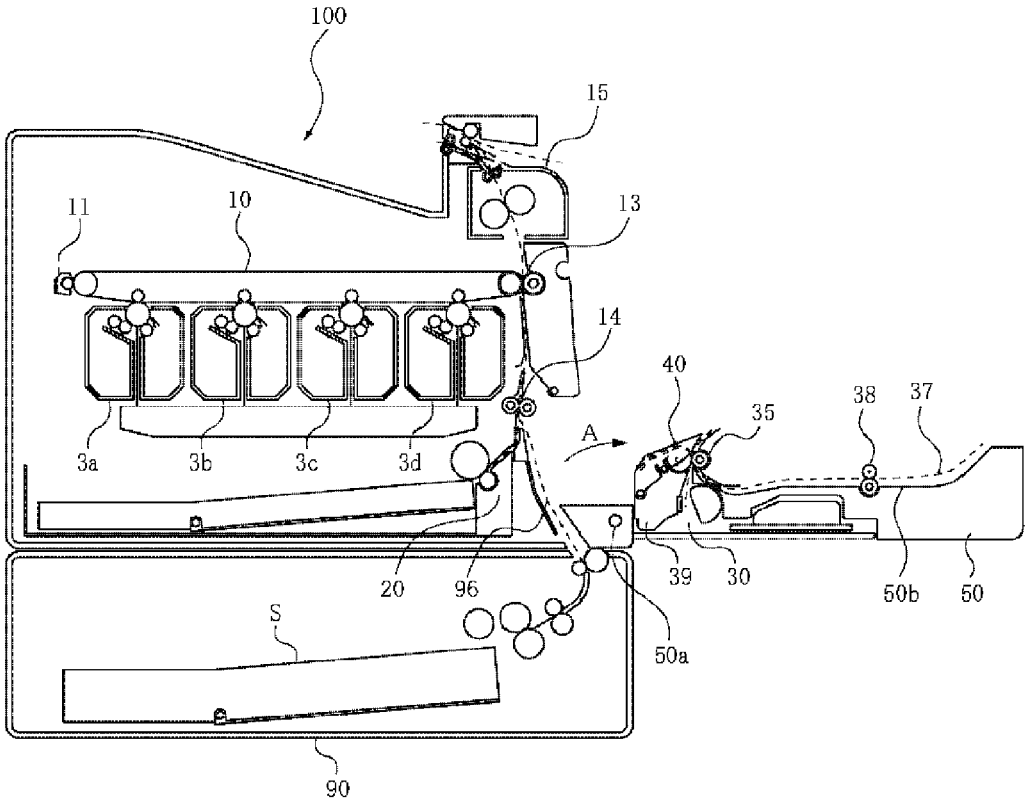
FIG. 3 is a schematic view for describing a state where a user access door is opened in the image forming apparatus of the first embodiment of the invention.

FIG. 3 is a sectional view of the image forming apparatus 100, and illustrates a state where the user access door 50 is opened. The user access door 50 can turn around a door rotation fulcrum 50*a* with respect to the apparatus body.

(Jam Recovery Operation)

Next, a user's operation for processing remaining sheets when jam is generated during printing operation in this embodiment. When jam is generated, a user opens the user access door 50 to open the conveying paths as illustrated in FIG. 3 and with this, and remaining sheets can be taken out.

When the user access door 50 is opened, the roller nip of the pair of registration rollers 14 and the pair of sheet re-feed rollers 35 is not released. Therefore, it becomes easy to align the pair of sheet re-feed rollers 35 and the pair of registration rollers 14. Since it is unnecessary for a user to operate the user access door 50 against the nip pressure of the pair of registration rollers 14 and the pair of sheet re-feed rollers 35, the operability is excellent.

When the user access door 50 is opened, a gear train (not illustrated) which transmits a driving force from a motor to the pair of sheet re-feed rollers 35 is cut off. As illustrated in FIG. 3, if the user access door 50 is opened, the two-sided inverse conveying path 37 is largely opened and the jam recovery operation can be carried out.

Figure 4:
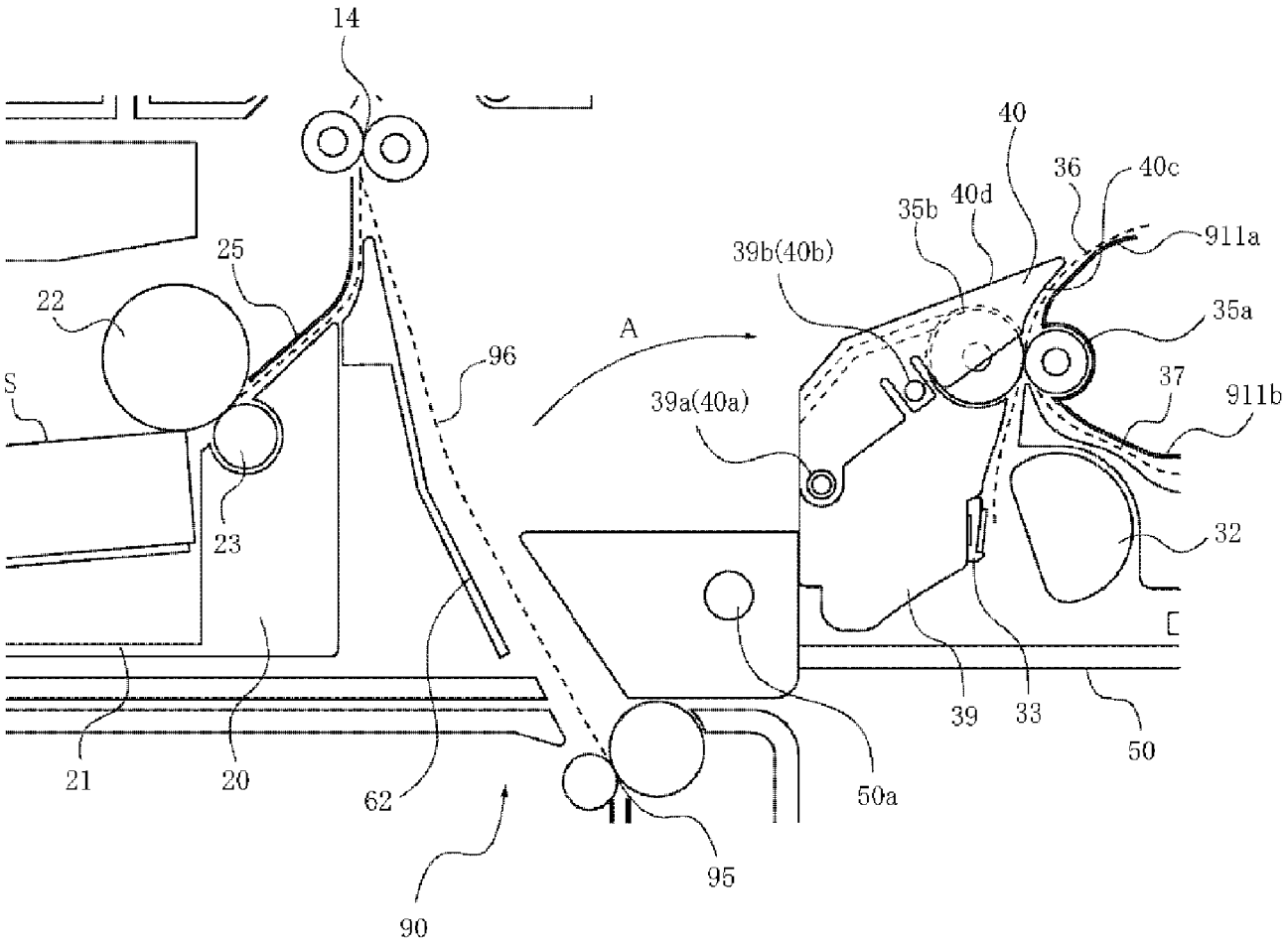
FIG. 4 is an enlarged view of an upstream area of a pair of registration rollers illustrated in FIG. 3.
Figure 5:
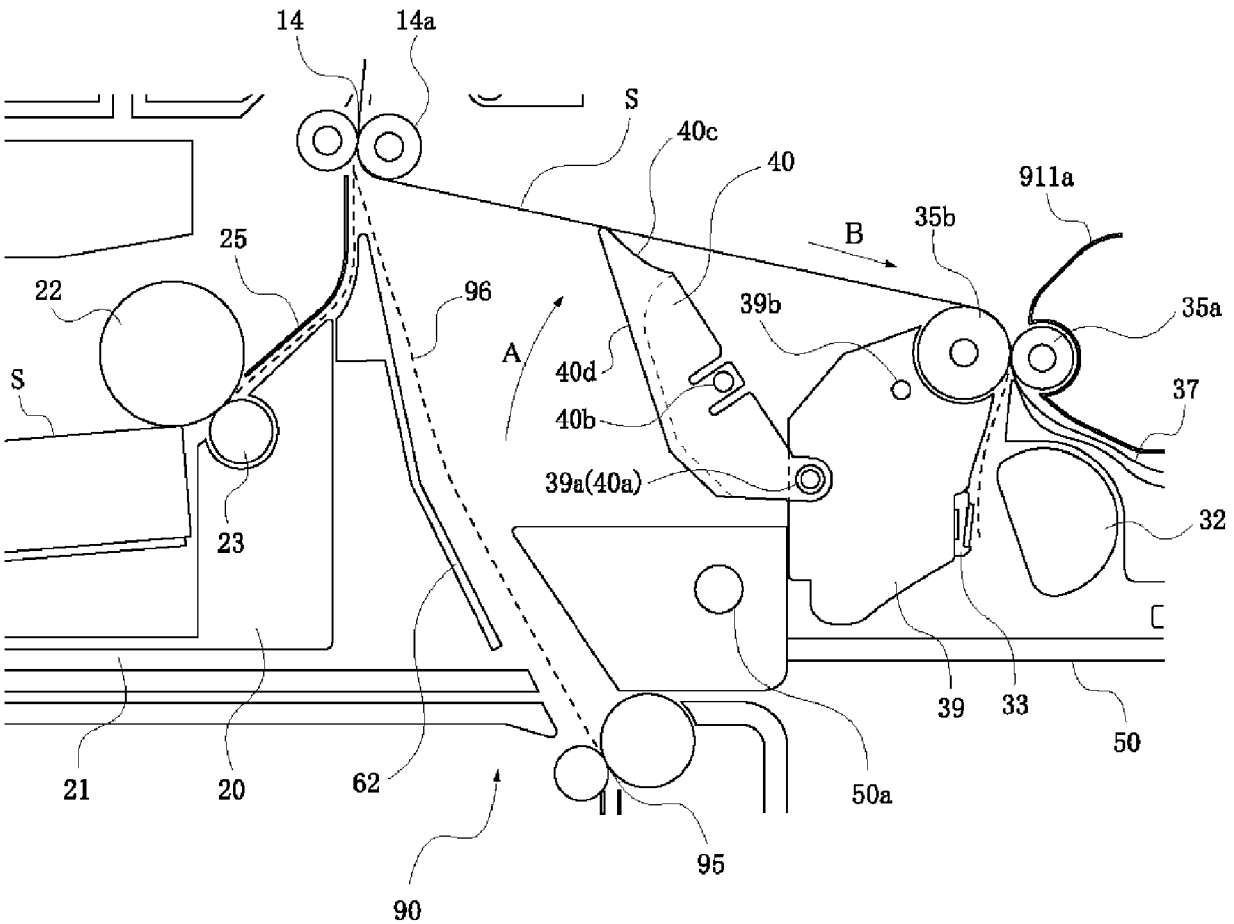
FIG. 5 is a schematic view for describing jam recovery operation for jam generated in a two-sided sheet re-feeder in the image forming apparatus of the first embodiment of the invention.

Next, operation around the two-sided sheet re-feeder caused by opening and closing of the user access door 50 will be described with reference to FIGS. 4 and 5. FIGS. 4 and 5 are enlarged views around the two-sided sheet re-feeder in FIG. 3, and illustrate a state where the user access door 50 is opened.

When there is no jammed sheet between the pair of sheet re-feed rollers 35 and the pair of registration rollers 14, as illustrated in FIG. 4, the sheet re-feed conveying guide member 40 follows the opening motion of the user access door 50 and rotates in a state where the sheet re-feed conveying guide member 40 is engaged with the manual sheet feed frame 39.

In this case, there is no remaining sheet in the sheet re-feed conveying path 36 downstream of the pair of sheet re-feed rollers 35. Therefore, it is unnecessary to open the sheet re-feed conveying path 36. Even if the user access door 50 is opened, the sheet re-feed conveying guide member 40 does not move with respect to the user access door 50, and the user access door 50 and the sheet re-feed conveying guide member 40 integrally move. The boss 39*b* provided on the manual sheet feed frame 39 and the engaging hole 40*b* of the sheet re-feed conveying guide member 40 are engaged with each other, and the sheet re-feed conveying guide member 40 is engaged with the manual sheet feed frame 39. Therefore, as the user access door 50 opens, the sheet re-feed conveying guide member 40 also moves and thus, the optional sheet feed conveying path 96 formed by the first optional sheet feed conveying path surface 40*d* of the sheet re-feed conveying guide member 40 largely opens. Since the optional sheet feed conveying path 96 can open, it is possible to easily remove a sheet remaining in the optional sheet feed conveying path 96.

A case where a remaining sheet is nipped between the sheet re-feed roller 35*a*, the sheet re-feed roller 35*b* and the pair of registration rollers 14 will be described using FIG. 5.

In a state where a sheet is nipped between the sheet re-feed roller 35*a*, the sheet re-feed roller 35*b* and the pair of registration rollers 14, the user access door 50 is opened. If the user access door 50 is opened, the sheet re-feed conveying guide member 40 provided on the user access door 50 tries to rotate in the direction of the sheet re-feed conveying path 36 (direction of the arrow A).

Since the gear train of the pair of sheet re-feed rollers 35 is cut off, the sheet re-feed roller 35*a* and the sheet re-feed roller 35*b* rotate by the friction of the sheet in a state where the sheet re-feed roller 35*a* and the sheet re-feed roller 35*b* nip the remaining sheet and in this state, they move in the direction of the arrow B. Tension is generated in the sheet in a portion between the pair of registration rollers 14, the sheet re-feed roller 35*a* and the sheet re-feed roller 35*b* by the pair of registration rollers 14, the sheet re-feed roller 35*a* and the sheet re-feed roller 35*b*. Therefore, the sheet assumes a substantially straight shape connecting a tangent between the sheet re-feed roller 35*b* and the right registration roller 14*a* of the pair of registration rollers 14 between the pair of registration rollers 14, the sheet re-feed roller 35*a* and the sheet re-feed roller 35*b*.

In the process of opening the user access door 50, the tip end of the sheet re-feed conveying guide member 40 comes into contact with the sheet S which assumes an attitude which coincides with a tangent connecting the registration roller 14*a* and the sheet re-feed roller 35*b*. If the user access door 50 is further opened after the tip end of the sheet re-feed conveying guide member 40 and the sheet S are contacted, the user access door 50 is pushed by the sheet S in which tension is generated, and the engaging hole 40*b* is disengaged. The engaging hole 40*b* is disengaged and the sheet re-feed conveying guide member 40 is separated from the manual sheet feed frame 39 such that the sheet re-feed conveying guide member 40 moves with respect to the manual sheet feed frame 39. Then, the sheet re-feed conveying guide member 40 does not follow the opening motion of the user access door 50 (manual sheet feed frame 39), and if the user access door 50 opens, the user access door 50 is separated away from the sheet re-feed conveying guide member 40 correspondingly. Since the curve guide member 911 and the sheet re-feed conveying guide member 40 are separated from each other, the sheet re-feed conveying path 36 is opened.

With this above-described structure of the sheet re-feed conveying guide member 40, a remaining sheet can be prevented from being possibly damaged or torn, and the sheet re-feed conveying guide member 40 can be prevented from being possibly damaged when the roller nip of the pair of sheet re-feed rollers 35 and the pair of registration rollers 14 are not released.

When a jammed sheet S remains in the sheet re-feed conveying path 36 remains, since the sheet re-feed conveying guide member 40 moves with respect to the user access door 50, the sheet re-feed transfer surface 40*c* is largely opened. When a jammed sheet S remains in the optional sheet feed conveying path 96, the sheet re-feed conveying guide member 40 follows the user access door 50 and rotates, and the optional sheet feed conveying path 96 formed by the first optional sheet feed conveying guide surface 40*d* is largely opened.

A user can find at a glance which of the sheet re-feed conveying path 36 and the optional sheet feed conveying path 96 a sheet S exists by carrying out one action, i.e., opening of the user access door 50. Therefore, it is possible to easily carry out the jam recovery operation.

As described above, even with a structure in which a plurality of conveying paths are concentrated and the plurality of conveying guides are superposed, it is possible to enhance the visibility of remaining sheets S and to enhance the jam recovery operability.

When the jammed sheet S is removed and the user access door 50 is closed from the state illustrated in FIG. 5, the manual sheet feed frame 39 catches the sheet re-feed conveying guide member 40. The engaging hole 40*b* of the sheet re-feed conveying guide member 40 is engaged with the boss 39*b* provided on the manual sheet feed frame 39, the apparatus can be returned to a state where printing can be carried out by one action, i.e., closing of the user access door 50.

The sheet re-feed conveying guide member 40 is held by the manual sheet feed frame 39 by the engagement between the engaging hole 40*b* and the boss 39*b* in the embodiment. Instead of this structure, the manual sheet feed frame may be formed with an engaging hole, and a boss which is engaged with the engaging hole may be formed on the sheet re-feed conveying guide member 40.

The sheet re-feed conveying guide member 40 and the manual sheet feed frame 39 may be engaged such that if the user access door 50 is opened, the sheet re-feed conveying guide member 40 is separated from the manual sheet feed frame 39 by a sheet S.

A rotation fulcrum 40*a* of the sheet re-feed conveying guide member 40 may be provided with a torsional coil spring, and a force may be applied to the sheet re-feed conveying guide member 40 in the direction of the arrow A by the torsional coil spring. In this case, a stopper which restricts rotation of the sheet re-feed conveying guide member 40 to which a force in the direction of the arrow A is applied by the torsional coil spring is provided. With this structure, when a jammed sheet S remains in the optional sheet feed conveying path 96, the sheet re-feed conveying guide member 40 follows the user access door 50 and rotates, and the optional sheet feed conveying path 96 formed in the first optional sheet feed conveying path surface 40*d* is largely opened. When a jammed sheet S remains in the sheet re-feed conveying path 36, the user access door 50 is opened and the sheet re-feed conveying guide member 40 is moved against a force applied to the user access door 50 by the torsional coil spring by the sheet. Therefore, the sheet re-feed conveying surface 40*c* is largely opened. When the user access door 50 is closed from the state illustrated in FIG. 5, the sheet re-feed conveying guide member 40 is moved to a place where the movement thereof is restricted by the stopper by a force applied to the manual sheet feed frame 39 by the torsional coil spring. Thus, the apparatus returns to a state where printing can be carried out by one action.

Second Embodiment

Next, a second embodiment of the image forming apparatus which is one example of the sheet processing apparatus of the present invention will be described in detail with reference to FIGS. 6 to 9. Members of the second embodiment having the same structures and functions as those of the first embodiment are designated with the same symbols and description thereof will be omitted.

Figure 6:
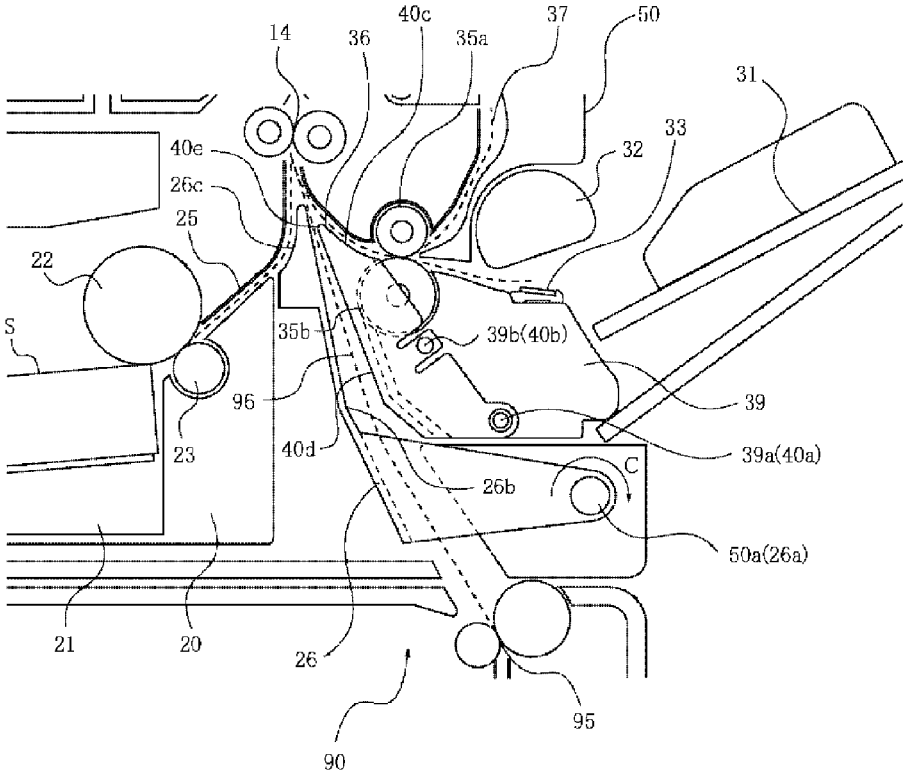
FIG. 6 is a vertical sectional view for describing an outline structure of an upstream area of a pair of registration rollers of an image forming apparatus of a second embodiment of the invention.

FIG. 6 is an enlarged view of the sheet re-feeder and its periphery in the image forming apparatus of the second embodiment. The second embodiment is different from the first embodiment in that the user access door 50 is provided with a member (optional conveying guide 26) which forms the optional sheet feed conveying path 96. The structures of the second embodiment will be described in detail.

In FIG. 6, the optional conveying guide 26 includes an optional conveying surface 26*b* which is a sheet conveying surface for guiding a sheet conveyed through the optional sheet feed conveying path 96. The optional conveying guide 26 further includes a body sheet feed conveying surface 26*c* which guides a sheet fed from the body sheet feeder 20 and conveyed through the body sheet feed conveying path 25.

The optional conveying guide 26 is movably supported by the user access door 50 around the door rotation fulcrum 50*a*, and a rotation shaft 26*a* thereof is provided with a torsional coil spring (not illustrated). A force is applied to the optional conveying guide 26 by the torsional coil spring in the direction of the arrow C. The rotation shaft 26*a* constitutes a movable unit which enables the optional conveying guide 26 to move with respect to the user access door 50.

Figure 7:
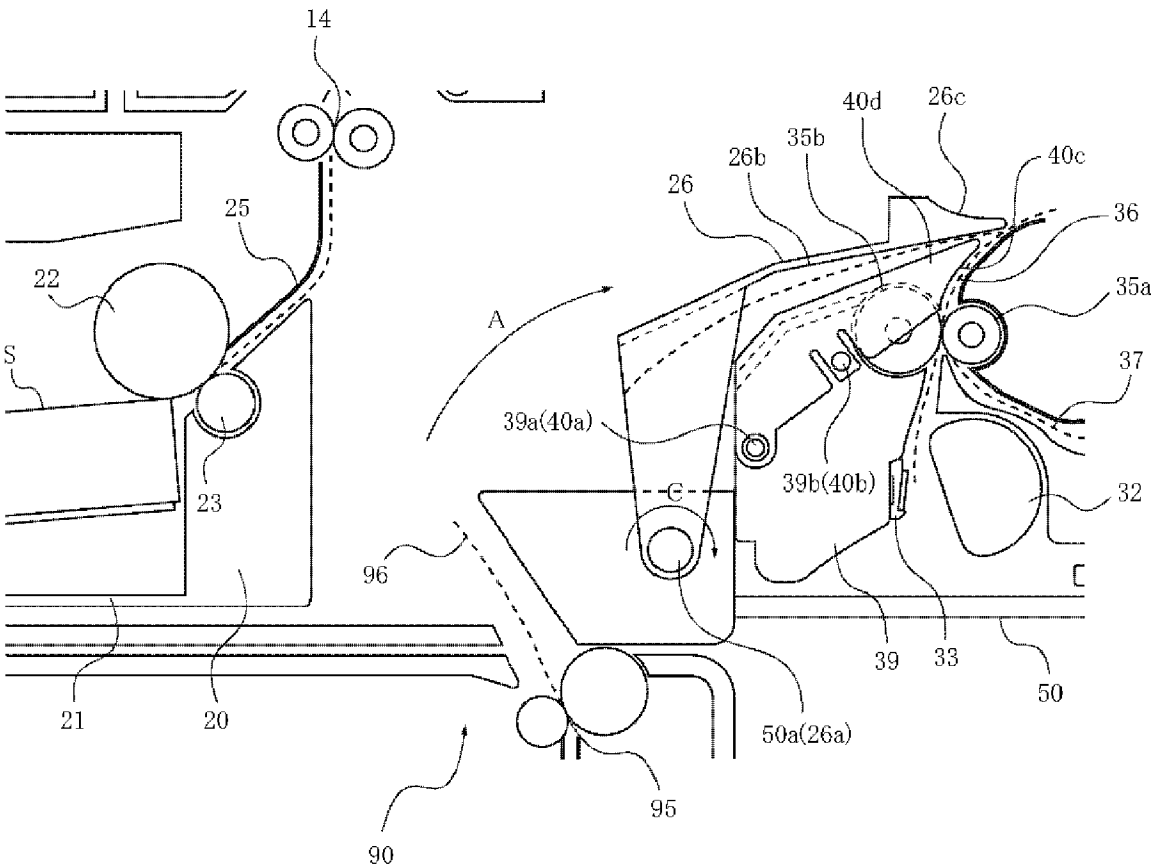
FIG. 7 is a schematic view for describing a state where an user access door is opened in the image forming apparatus of the second embodiment of the invention.
Figure 8:
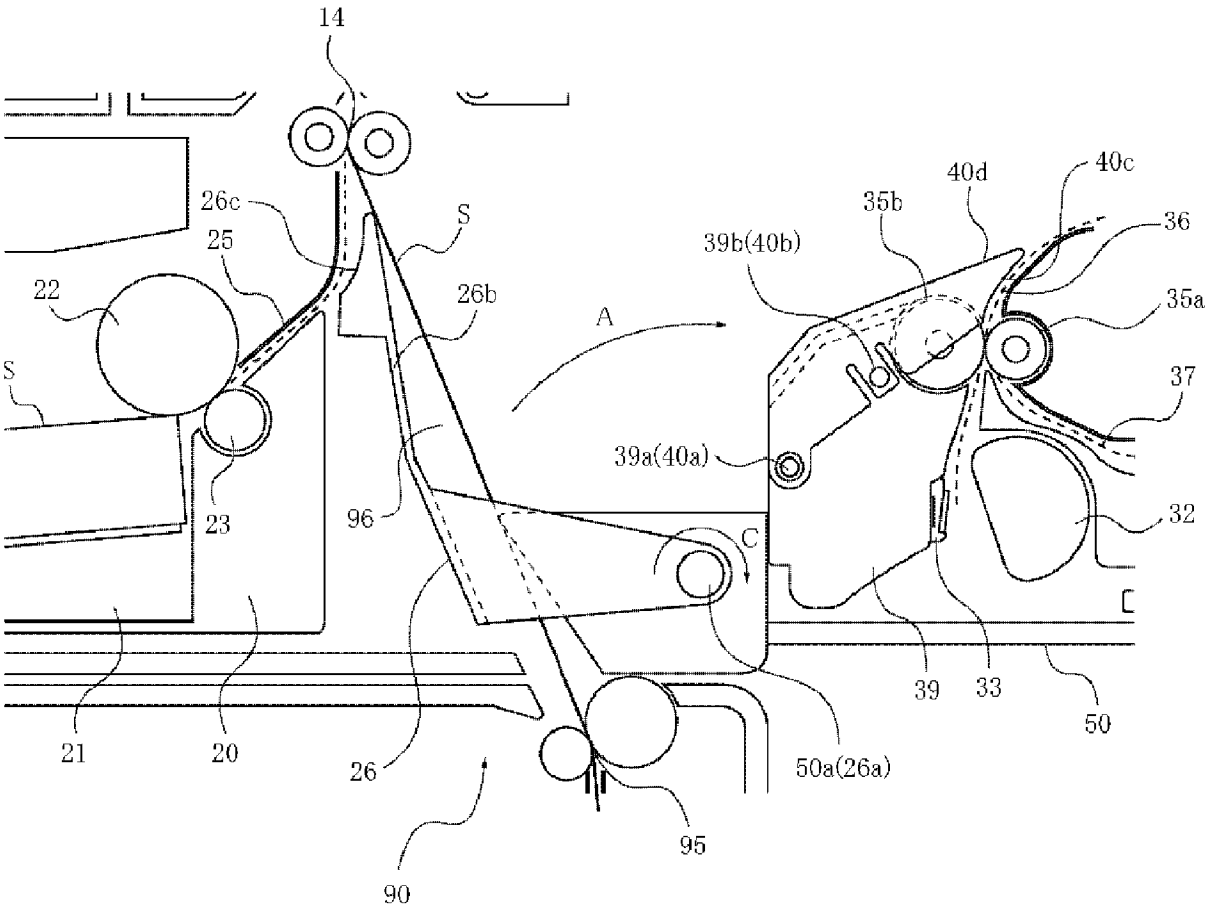
FIG. 8 is a schematic view for describing a jam recovery operation of jam generated in an optional sheet feed conveying portion in the image forming apparatus of the second embodiment of the invention.

The jam recovery operation in the second embodiment will be described with reference to FIGS. 7 and 8. FIG. 7 illustrates a state where the user access door 50 is opened when a sheet S does not remain between the pair of registration rollers 14 and the pair of optional discharge rollers 95, i.e., in the optional sheet feed conveying path 96. FIG. 8 illustrates a state where the user access door 50 is opened when a sheet S is nipped between the pair of registration rollers 14 and the pair of optional discharge rollers 95.

When a jammed sheet S does not remain between the pair of registration rollers 14 and the pair of optional discharge rollers 95, the optional conveying guide 26 follows the user access door 50 and rotates by action of the torsional coil spring disposed on the rotation shaft 26*a*. As a result, the body sheet feed conveying path 25 is opened, and it is possible to access the body sheet feed conveying path 25.

A case where a remaining sheet S is nipped between the pair of registration rollers 14 and the pair of optional discharge rollers 95 will be described. In this case, although the optional conveying guide 26 follows the user access door 50 and starts rotating, if the optional conveying guide 26 abuts against the remaining sheet S, the optional conveying guide 26 stays at that location by the sheet S. The sheet is nipped between the pair of registration rollers 14 and the pair of optional discharge rollers 95. Therefore, if the user access door 50 moves in its opening direction in a state where the optional conveying guide 26 is in contact with a portion of the sheet located between the pair of registration rollers 14 and the pair of optional discharge rollers 95, tension is generated in the sheet. Therefore, if the user access door 50 is opened, the optional conveying guide 26 moves with respect to the user access door 50, and the optional conveying surface 26*b* on which the sheet S remains is largely opened.

The optional conveying guide 26 is operated like the sheet re-feed conveying guide member 40 described in the first embodiment. That is, the optional conveying guide 26 rotates in a direction of a sheet remaining in the optional sheet feed conveying path 96, and the optional conveying guide 26 is pushed under pressure by the sheet and the optional conveying guide 26 is separated from the user access door 50, and the conveyed surface is largely opened. That is, the roller nip between the pair of registration rollers 14 and the pair of optional discharge rollers 95 is not released, and when there is a remaining sheet, if the user access door 50 is opened, the optional conveying guide 26 can move with respect to the user access door 50 as in the first embodiment. Therefore, the probability that a remaining sheet S is torn or the optional conveying guide 26 is damaged is lowered.

That is, in the second embodiment, the conveying guide between the pair of registration rollers 14 and the pair of sheet re-feed rollers 35 used in the first embodiment is applied to a structure of the conveying guide between the pair of registration rollers 14 and the pair of optional discharge rollers 95. Like the first embodiment, a structure for preventing the optional conveying guide 26 from separating from the user access door 50 by a sheet S is not limited to the above structure.

In the second embodiment also, when there is a sheet in the sheet re-feed conveying path 36 as described in the first embodiment, if the user access door 50 is opened, the sheet re-feed conveying guide member 40 moves with respect to the user access door 50.

Even when a sheet S remains in the conveying path in any of the sheet re-feed conveying path 36, the optional sheet feed conveying path 96 and the body sheet feed conveying path 25, it is possible to handle only by one action, i.e., by opening the user access door 50. That is, when a jammed sheet S remains in the sheet re-feed conveying path 36, the two-sided sheet re-feed guide 40 opens. When a jammed sheet S remains in the optional sheet feed conveying path 96, the optional conveying guide 26 opens. When a jammed sheet S remains in the body sheet feed conveying path 25, the two-sided sheet re-feed guide 40 and the optional conveying guide 26 rotate together with the user access door 50, and the body sheet feed conveying path 25 is exposed. A user can find a location of a jammed sheet by one action, i.e., by opening the user access door 50, and it is possible to provide an image forming apparatus having excellent visibility and the jam recovery operability.

Figure 9:
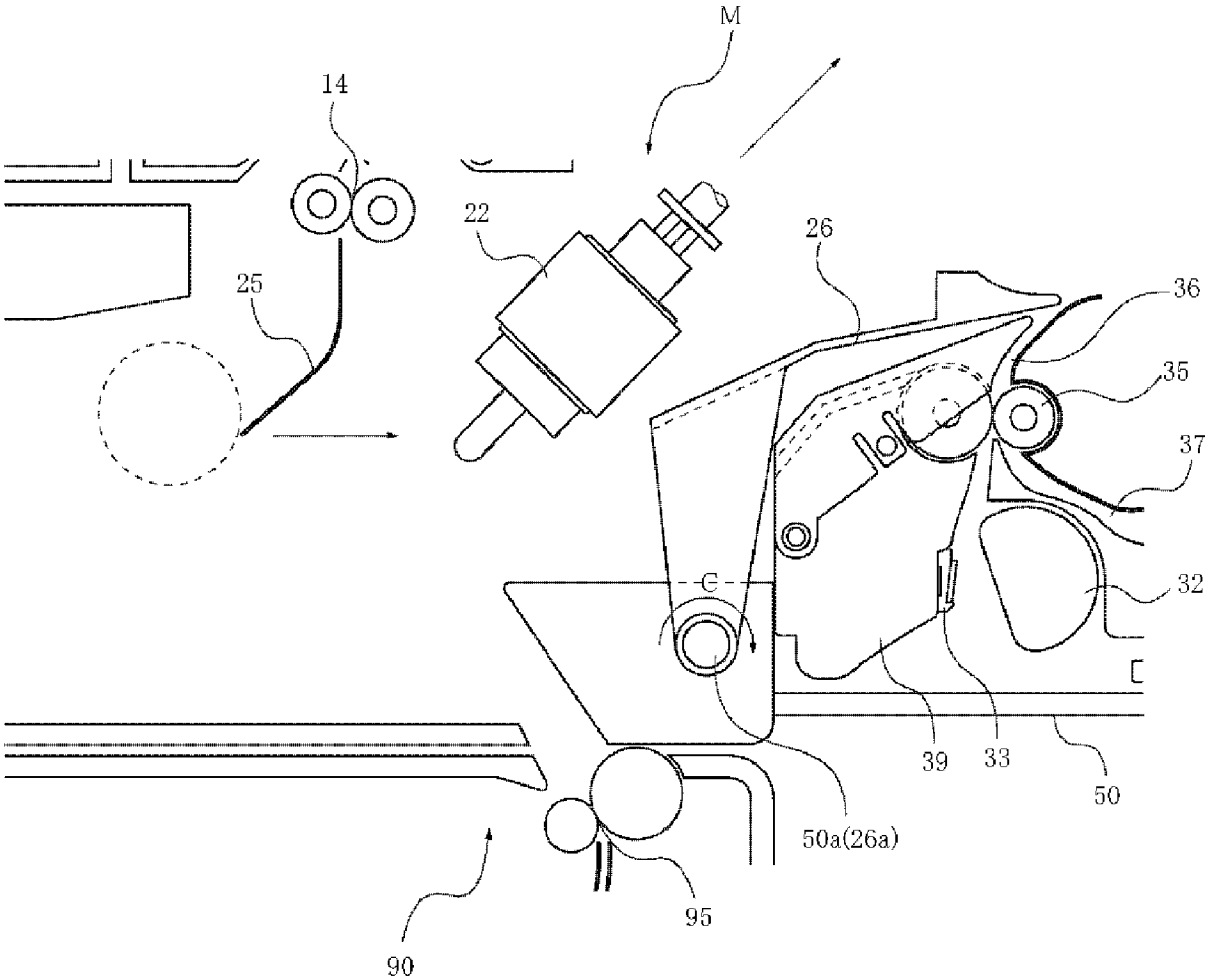
FIG. 9 is a schematic view for describing an exchanging operation of the sheet feed roller of a body sheet feeder in the image forming apparatus according to the second embodiment of the invention.

Here, replacement of the sheet feed roller 22 which is a replacement part will be described. As illustrated in FIG. 6, the sheet feed roller 22 is disposed inside the optional conveying guide 26 and in the apparatus body. When the sheet feed roller 22 is replaced, the sheet feed cassette 21 is first detached from the apparatus body from a state illustrated in FIG. 6 where the sheet feed cassette 21 is attached. Then, in the state where the sheet feed cassette 21 is detached from the apparatus body, the user access door 50 is opened. FIG. 9 illustrates the state where the user access door 50 is opened in this manner. If the user access door 50 is opened in a state where there is no remaining sheet S, the sheet feed roller 22 which is the replacement part is largely exposed, and the sheet feed roller 22 can easily be replaced. That is, if the user access door 50 is opened, the optional conveying guide 26 also moves together with the user access door 50. If the optional conveying guide 26 moves, an attaching/detaching space M for the replacement part through which inside and outside of the apparatus body is connected is formed. The sheet feed roller 22 which is the replacement part can be detachably attachable from the apparatus body through the attaching/detaching space M.

Third Embodiment

An example in which a conveying guide which retracts by tension of a jammed sheet S is applied to an image forming apparatus of another type will be described as a third embodiment of the present invention.

Figure 10:
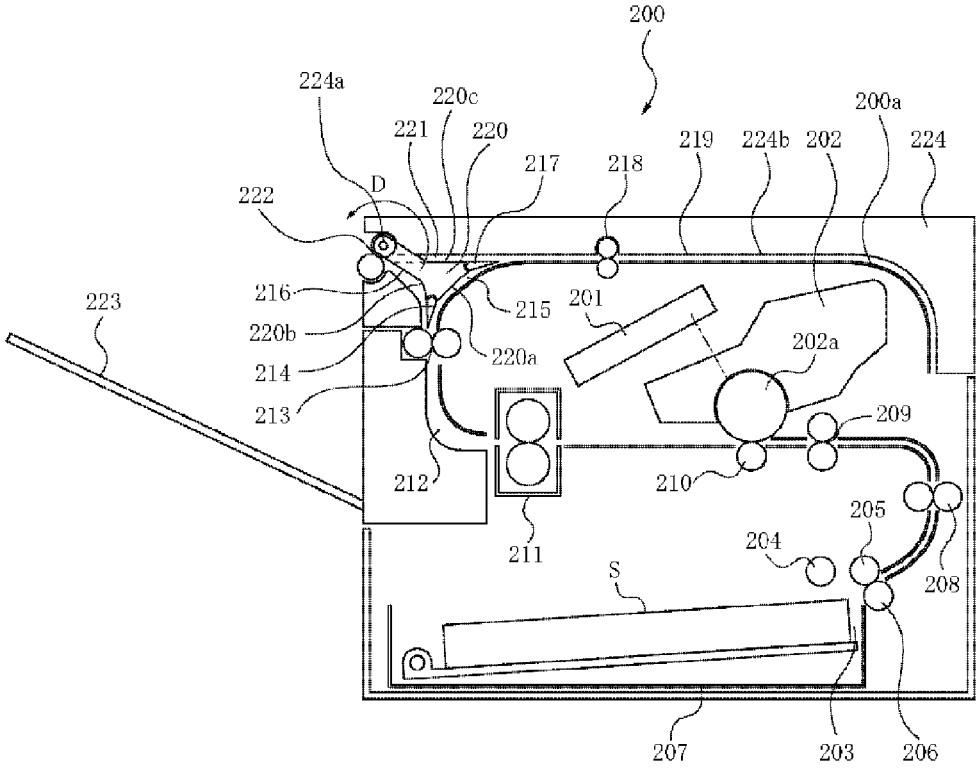
FIG. 10 is a vertical sectional view for describing an outline structure of an image forming apparatus of a third embodiment of the invention.

FIG. 10 is a vertical sectional view for describing an outline structure of an image forming apparatus 200 according to the third embodiment.

The image forming apparatus 200 is provided at its lower portion with a sheet supply portion 203. The sheet supply portion 203 includes a cassette 207 in which a plurality of sheets S are stacked, and a pick roller 204 for sending out the sheets accommodated in the cassette 207. The sheet supply portion 203 includes a roller 205 and a separating/conveying roller 206 for separating sheets sent out by the pick roller 204 and for conveying the sheets.

The image forming apparatus 200 includes a photosensitive drum 202*a* as an image bearing member above the cassette 207. The image forming apparatus 200 further includes a cartridge process unit 202 which transfers a toner image on the photosensitive drum 202*a* onto a sheet, and a laser scanner 201 which outputs laser light for forming an electrostatic latent image based on an image signal on the photosensitive drum 202*a*. The laser scanner 201 is located above the cartridge process unit 202. A fixing device 211 is disposed downstream of the cartridge process unit 202 in the conveying direction of a sheet. The fixing device 211 heats and pressurizes a sheet S onto which a toner image is transferred by the photosensitive drum 202*a*, and fixes the toner image to the sheet.

A pair of intermediate conveying rollers 208 and a pair of registration rollers 209 are provided between the sheet supply portion 203 and the photosensitive drum 202*a*. The pair of intermediate conveying rollers 208 and the pair of registration rollers 209 convey, to the photosensitive drum 202*a*, a sheet conveyed from the sheet supply portion 203.

A pair of merging rollers 213 which convey sheets from the fixing device 211, a merging/rocking guide 214 which can rock, and an intermediate conveying guide unit 220 which can turn around a rocking fulcrum 224*a* to the apparatus body are provided above the fixing device 211.

The intermediate conveying guide unit 220 mage forming apparatus 200 forms three conveying paths. That is, the intermediate conveying guide unit 220 forms a face up conveying path 216, a merging/conveying path 215 and a face down conveying path 221. More specifically, a merging/conveying surface 220*a*, a face up conveying surface 220*b* and a face down conveying surface 220*c* of the intermediate conveying guide unit 220 form the face up conveying path 216, the merging/conveying path 215 and the face down conveying path 221. The face up conveying path 216 is a conveying path extending from the pair of merging rollers 213 to a pair of discharge rollers 222. The merging/conveying path 215 is a conveying path through which sheets pass from the pair of merging rollers 213 toward the pair of inverse rollers 218. The face down conveying path 221 is a conveying path through which sheets pass from the pair of inverse rollers 218 toward the pair of discharge rollers 222.

The merging/rocking guide 214 is provided upstream of the intermediate conveying guide unit 220. A position of the merging/rocking guide 214 is changed for guiding a sheet to the face up conveying path 216 or to the merging/conveying path 215.

The intermediate conveying guide unit 220 is provided at its end with an intermediate rocking guide 217. The intermediate rocking guide 217 is rockably provided on the intermediate conveying guide unit 220. The intermediate rocking guide 217 guides, into the face down conveying path 221, a sheet sent by the pair of inverse rollers 218 toward the pair of discharge rollers 222.

A substantially horizontal inverse conveying path 219 is provided above the photosensitive drum 202*a* and the fixing device 211. A sheet conveyed by the pair of inverse rollers 218 passes through the inverse conveying path 219. A body guide surface 200*a* formed in the body and a door-side guide surface 224*b* formed on the opening/closing door 224 form the inverse conveying path 219.

The face up conveying path 216 is formed by the face up conveying surface 220*b* of the intermediate conveying guide unit 220 and a body frame guide. The merging/conveying path 215 is formed by the face up conveying surface 220*b* of the intermediate conveying guide unit 220 and the body guide surface 200*a*. The face down conveying path 221 is formed by the face up conveying surface 220*c* of the intermediate conveying guide unit 220 and a door-side guide surface 224*b*.

A user opens an opening/closing door 224 as an opening/closing member for removing a sheet which remains in a conveying path downstream from the fixing device 211.

An image forming operation of the image forming apparatus 200 will be described.

A sheet supplied by the sheet supply portion 203 is conveyed to a peripheral surface of the photosensitive drum 202*a* by the pair of intermediate conveying rollers 208 and the pair of registration rollers 209.

A toner image is transferred to a sheet conveyed to the peripheral surface of the photosensitive drum 202*a* when the sheet is conveyed between the photosensitive drum 202*a* and the transfer roller 210. Then, the toner image conveyed and transferred to the fixing device 211 is fixed. The image is formed on an upper surface of the sheet S in FIG. 10.

The sheet on which the image was fixed by the fixing device 211 is conveyed by the pair of merging rollers 213 through the conveying path 212 after the fixing. Conveying paths through which a sheet is conveyed are switched in accordance with orientation of an image in a state where the sheet is stacked on the discharge tray 223 downstream of the pair of merging rollers 213. That is, the conveying paths are switched depending upon a face up stacking state where an image surface is stacked upwardly on the discharge tray 223 and a face down stacking state where an image surface is stacked downwardly on the discharge tray 223.

In the case of the face up stacking state, a sheet S to which an image is fixed passes through the pair of merging rollers 213, the sheet S is guided such that the sheet S passes through the face up conveying path 216 by the merging/rocking guide 214, and is stacked on the discharge tray 223 by the pair of discharge rollers 222 such that the image surface faces up.

When the face down stacking state is selected, a sheet S to which an image is fixed is guided into the merging/conveying path 215 by the merging/rocking guide 214, and is further conveyed to the inverse conveying path 219 and nipped by the pair of inverse rollers 218. The intermediate rocking guide 217 closes the outlet of the merging/conveying path 215 by its own weight, but the intermediate rocking guide 217 is lifted up by a sheet S conveyed through the merging/conveying path 215.

The sheet S conveyed into the inverse conveying path 219 is conveyed by the pair of inverse rollers 218 and a rear end of the sheet S passes through the intermediate rocking guide 217. The rotation direction of the pair of inverse rollers 218 is reversed at the timing when the rear end of the sheet S passes through the intermediate rocking guide 217, the conveying direction of the sheet S is reversed, and the sheet S is conveyed to the face down conveying path 221. A sheet is guided into the face down conveying path 221 by the intermediate rocking guide 217. The sheet S turned over by the pair of inverse rollers 218 is stacked on the discharge tray 223 by the pair of discharge rollers 222 such that the image surface faces down.

The structure of the conveying path downstream from the pair of merging rollers 213 and the jam recovery operation will be described in detail.

The rocking fulcrum 224*a* is a rocking fulcrum of the opening/closing door 224 provided coaxially with an upper roller of the pair of discharge rollers 222. The intermediate conveying guide unit 220 has a rotation fulcrum 220*a* coaxially with the rocking fulcrum 224*a* of the opening/closing door 224. The intermediate conveying guide unit 220 is rotatably supported with respect to the opening/closing door 224. A torsional coil spring (not illustrated) is disposed on a rotation fulcrum 220*d* of the intermediate conveying guide unit 220, and a force in the direction of the arrow D is applied to the intermediate conveying guide unit 220.

The pair of inverse rollers 218 and the pair of discharge rollers 222 determine the discharge stacking performance of sheets S stacked on the discharge tray 223, and alignment thereof is important. Thus, even if the opening/closing door 224 is opened for the jam recovery operation, it is preferable that the roller nip is not released. Hence, in this embodiment, the pair of inverse rollers 218 and the pair of discharge rollers 222 are not separated even if the opening/closing door 224 is opened.

Figure 11:
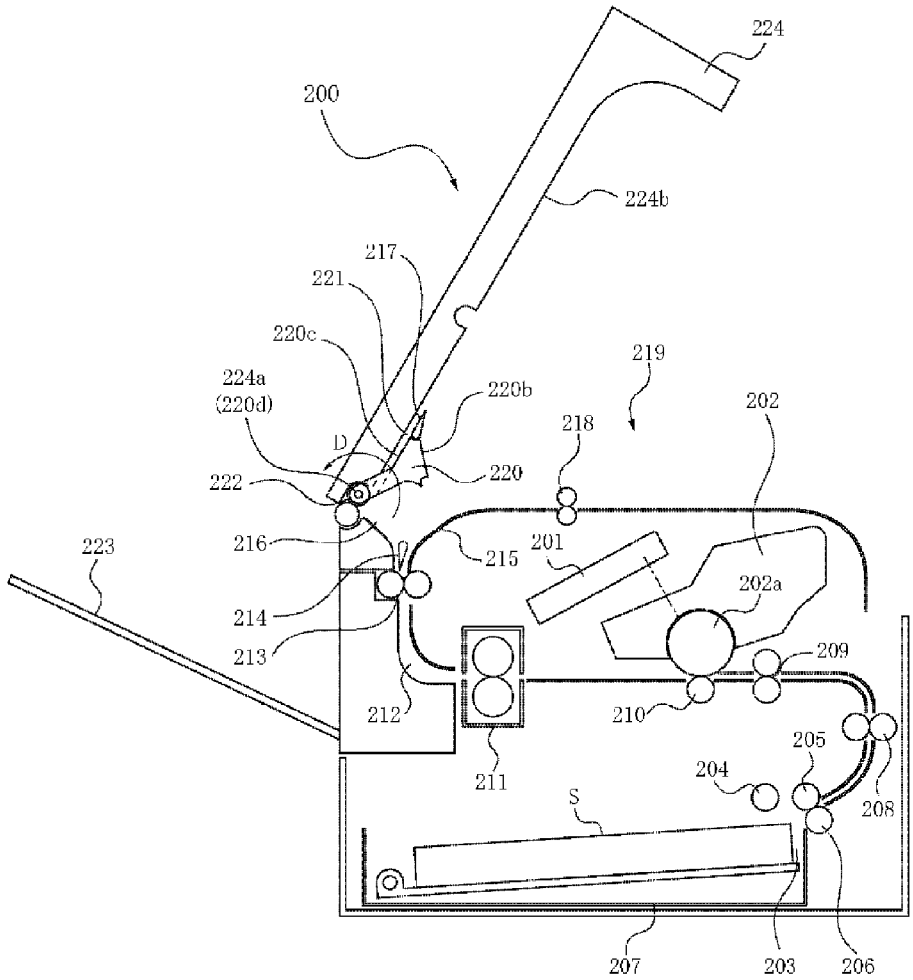
FIG. 11 is a schematic view for describing a state where an opening/closing door is opened in the image forming apparatus of the third embodiment of the invention.
Figure 12:
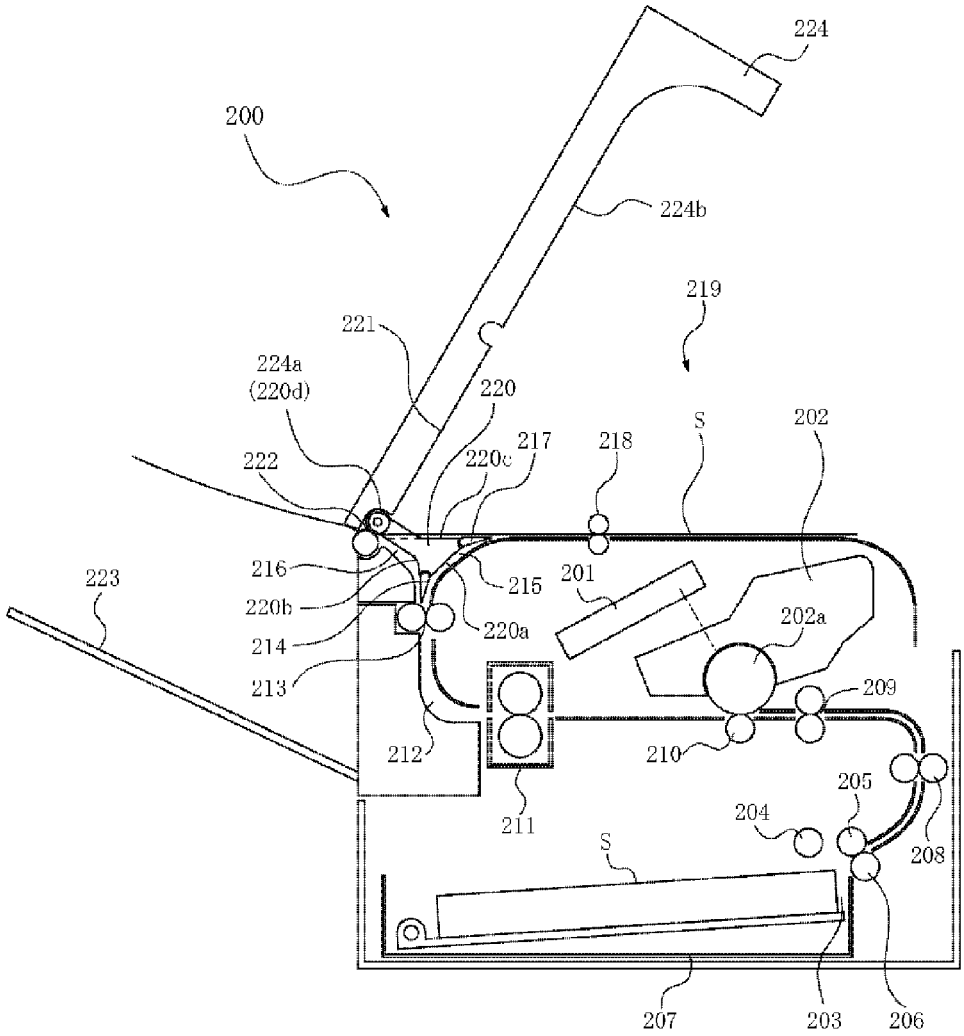
FIG. 12 is a schematic view for describing jam recovery operation of jam generated in a face down conveying path in the image forming apparatus of the third embodiment of the invention.
Figure 13:
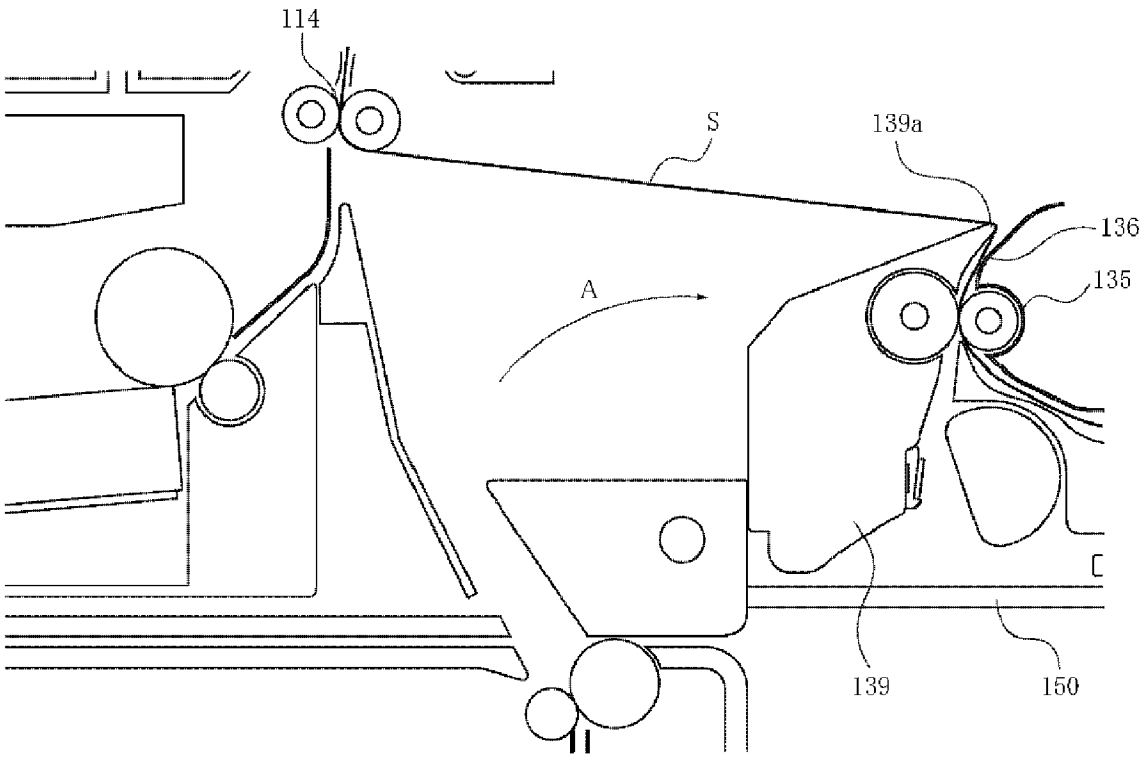
FIG. 13 PRIOR ART
FIG. 13 is a diagram for describing a problem of the invention.

FIG. 11 illustrates a state when the opening/closing door 224 is opened in a state where no sheet S remains between the pair of inverse rollers 218 and the pair of discharge rollers 222. FIG. 12 illustrates a state where the opening/closing door 224 is opened when a remaining sheet S is nipped between the pair of inverse rollers 218 and the pair of discharge rollers 222.

As illustrated in FIG. 11, when there is no sheet S between the pair of inverse rollers 218 and the pair of discharge rollers 222, the intermediate conveying guide unit 220 is opened upward together with the opening/closing door 224 by action of the torsional coil spring (not illustrated). At the same time, the merging/conveying path 215 and the face up conveying path 216 are opened.

When a remaining sheet S is nipped between the pair of inverse rollers 218 and the pair of discharge rollers 222, the opening/closing door 224 and the intermediate conveying guide unit 220 which open are separated from each other by the sheet S as illustrated in FIG. 12. The sheet S is nipped between the pair of inverse rollers 218 and the pair of discharge rollers 222. Therefore, if the opening/closing door 224 moves in its opening direction in a state where the intermediate conveying guide unit 220 is in contact with a portion of the sheet S between the pair of inverse rollers 218 and the pair of discharge rollers 222, tension is generated in the sheet. Then, the face down conveying path 221 formed by the intermediate conveying guide unit 220 is largely opened.

The intermediate conveying guide unit 220 which is the conveying guide tries to rotate toward the sheet S nipped between the pair of inverse rollers 218 and the pair of discharge rollers 222. However, since the intermediate conveying guide unit 220 moves by the sheet S with respect to the opening/closing door 224 which opens, the sheet S is not damaged or torn. That is, if the opening/closing door 224 which is the opening/closing member opens in a state where a sheet S remains on the face down conveying surface 220*c* of the intermediate conveying guide unit 220, the intermediate conveying guide unit 220 is moved by the remaining sheet with respect to the opening/closing door 224.

With this above structure, when a sheet S remains in the face down conveying path 221, the intermediate conveying guide unit 220 functions to open the face down conveying path 221. When a sheet remains in the merging/conveying path 215 and the face up conveying path 216, the intermediate conveying guide unit 220 opens upward together with the opening/closing door 224. Even when a sheet remains in any of the plurality of conveying paths, a user can carryout the jam recovery operation by one action, i.e., by opening the opening/closing door 224. With the above structure, it is possible to provide an image forming apparatus having excellent visibility and the jam recovery operability.

Any of the first to third embodiments can exhibit the following effects.

In an image forming apparatus in which a plurality of conveying paths merge with each other and a plurality of conveying guides are superposed on each other, even if a sheet remains in any of the conveying path, it is possible to clear a paper jam by one action, i.e., by opening the door. Further, since the conveying path in which a sheet remains is largely opened, the visibility of sheets and the jam recovery operability can be enhanced. In a pair of rollers which require high nip pressure and a pair of roller which requires high position precision, the roller nip is not released by opening the door, the sheet conveying performance is satisfied. The processing operation can be carried out while satisfying the sheet conveying performance without damaging a sheet such as flaw and tearing, and without damaging the conveying guide.

In the above description, the image forming apparatus which forms an image on a sheet is described as a sheet processing apparatus which processes a sheet. However, the present invention can be applied to any sheet processing apparatuses only if the apparatus processes a conveyed sheet. For example, the invention can be applied also to a finisher which carries out processing such as staple and punch with respect to a sheet, and to an image reading apparatus which reads an image on a conveyed sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-336847, filed Dec. 27, 2007, which is hereby incorporated by reference herein in its entirety.

What is claimed is:

1. A sheet processing apparatus comprising:

an apparatus body;

an opening/closing member turnably supported by the apparatus body;

a first conveyance portion which nips and conveys a sheet;

a second conveyance portion which nips and conveys a sheet; and a conveying guide which is movably supported on the opening/closing member and which guides a sheet between the first conveyance portion and the second conveyance portion, wherein the conveying guide is moved with the opening/closing member and the conveying guide crosses with a line passing the first conveyance portion and the second conveyance portion in a state in which the opening/closing member is opened, wherein in a case where a sheet is not nipped by the first conveyance portion and the second conveyance portion, the conveying guide is moved with the opening/closing member while opening the opening/closing member, and wherein in a case where a sheet is nipped by the first conveyance portion and the second conveyance portion, a movement of the conveying guide is regulated by the nipped sheet positioned on the line while opening the opening/closing member.

2. The sheet processing apparatus according to claim 1, wherein the first conveyance portion is a pair of first conveying rollers which nip and convey a sheet and the second conveyance portion is a pair of second conveying rollers which nip and convey a sheet, wherein according to a process that the opening/closing member opens in a state where a sheet is nipped by the pair of first conveying rollers and the pair of second conveying rollers, the conveying guide is pushed by the nipped sheet, and the conveying guide is moved relative to the opening/closing member.

3. The sheet processing apparatus according to claim 1, wherein the opening/closing member is provided with the first conveyance portion, and the apparatus body is provided with the second conveyance portion.

4. The sheet processing apparatus according to claim 1, wherein even when the opening/closing member opens in a state where a sheet is not nipped by the first conveying portion and the second conveying portion, the conveying guide does not move relative to the opening/closing member.

5. The sheet processing apparatus according to claim 1, further comprising:

a first conveying path which is formed by the sheet conveying surface of the conveying guide and through which a sheet is conveyed; and a second conveying path which can be opened if the opening/closing member opens, and which merges with the first conveying path, wherein the conveying guide is formed with a second sheet conveying surface which forms the second conveying path, and when the opening/closing member opens in a state where there is no sheet on the sheet conveying surface, the conveying guide follows the opening motion of the opening/closing member and moves together with the opening/closing member, thereby opening the second conveying path.

6. The sheet processing apparatus according to claim 1, wherein when the opening/closing member is opened in a state where a sheet is not nipped by the first conveyance portion and the second conveyance portion, the conveying guide moves together with the opening/closing member such as to follow the opening motion of the opening/closing member, and a replacement part can be detachably attachable from the apparatus body through a space which connects, with each other, outside and the apparatus body formed by movement of the conveying guide.

7. The sheet processing apparatus according to claim 1, further comprising a boss formed on one of the opening/closing member and the conveying guide, and a hole which is formed in the other one of the opening/closing member and the conveying guide and which is engaged with the boss, wherein when the opening/closing member is opened in a state where a sheet is not nipped by the first conveyance portion and the second conveyance portion, the conveying guide and the opening/closing member are integrally moved relative to the apparatus body by engagement between the boss and the hole, and when the opening/closing member is opened in a state where a sheet is nipped by the first conveyance portion and the second conveyance portion, the conveying guide is pushed under pressure by the nipped sheet, the engagement between the boss and the hole is released, and the conveying guide is moved relative to the opening/closing member.

8. The sheet processing apparatus according to claim 1, wherein the conveying guide is rotatably supported by the opening/closing member, and the opening/closing member and the conveying guide is pivoted by different rotating axis.

9. The sheet processing apparatus according to claim 1, further comprising:

an engaging portion which engages the conveying guide to the opening/closing member so that the conveying guide moves with the opening/closing member when the opening/closing member is opened in a case where a sheet is not nipped by the first conveyance portion and the second conveyance portion, wherein when the opening/closing member is opened in a state where the sheet is nipped by the first conveyance portion and the second conveyance portion, an engagement of the engaging portion between the conveying guide and the opening/closing member is released by being pushed by the nipped sheet.

* * * * *